US007427187B2

(12) United States Patent
Burdgick et al.

(10) Patent No.: US 7,427,187 B2
(45) Date of Patent: Sep. 23, 2008

(54) WELDED NOZZLE ASSEMBLY FOR A STEAM TURBINE AND METHODS OF ASSEMBLY

(75) Inventors: Steven Sebastian Burdgick, Schenectady, NY (US); Thomas William Crall, Clifton Park, NY (US); Thomas Patrick Russo, Galway, NY (US)

(73) Assignee: General Electric Company, Schenectady, NY (US)

( * ) Notice: Subject to any disclaimer, the term of this patent is extended or adjusted under 35 U.S.C. 154(b) by 197 days.

(21) Appl. No.: 11/331,024

(22) Filed: Jan. 13, 2006

(65) Prior Publication Data

US 2007/0166151 A1 Jul. 19, 2007

(51) Int. Cl.
*F01D 9/00* (2006.01)

(52) U.S. Cl. ..... 415/191; 415/209.3; 415/209.4; 415/210.1

(58) Field of Classification Search ..... 415/191, 415/209.3, 209.4, 210.1; 29/889.22
See application file for complete search history.

(56) References Cited

U.S. PATENT DOCUMENTS 1,740,800 A * 12/1929 Wiberg ..... 29/889.21
1,998,951 A * 4/1935 Downer ..... 415/209.4
2,245,237 A * 6/1941 Truex ..... 415/209.4
3,849,023 A * 11/1974 Klompas ..... 415/173.7
4,889,470 A * 12/1989 Scalzo ..... 415/209.2
5,586,864 A 12/1996 Knorowski et al.
5,593,273 A 1/1997 Brinkman
5,743,711 A 4/1998 Fournier et al.
5,788,456 A * 8/1998 Maier ..... 415/190
5,807,074 A 9/1998 Fournier et al.
6,196,793 B1 3/2001 Braaten
6,435,825 B1 8/2002 Kirby, III et al.
6,705,829 B1 3/2004 Brown et al.
6,754,956 B1 6/2004 Tomko et al.
6,888,090 B2 5/2005 Murphy
2004/0253095 A1 * 12/2004 Sasaki et al. ..... 415/191

* cited by examiner

*Primary Examiner*—Igor Kershteyn
(74) *Attorney, Agent, or Firm*—Nixon & Vanderhye, PC

(57) ABSTRACT

A steam turbine nozzle singlet having a blade or airfoil between inner and outer sidewalls is provided. The sidewalls include steps or flanges which are received in complementary recesses in the rings enabling axially short low heat input welds e.g., e-beam welds. These complementary steps and recesses mechanically interlock the singlet between the rings preventing displacement of the singlet in the event of weld failure. The low heat input welds minimize or eliminate distortion of the nozzle flow path. Additional features on the singlets, provide a datum for milling machines to form singlets of different sizes.

13 Claims, 6 Drawing Sheets

WELDED NOZZLE ASSEMBLY FOR A STEAM TURBINE AND METHODS OF ASSEMBLY

The present invention relates to nozzle assemblies for steam turbines and particularly relates to a welded nozzle assembly and methods of assembling the nozzle for purposes of improving the steam flow path.

BACKGROUND OF THE INVENTION

Steam turbines typically comprise static nozzle segments that direct the flow of steam into rotating buckets that are connected to a rotor. In steam turbines, the nozzle including the airfoil or blade construction is typically called a diaphragm stage. Conventional diaphragm stages are constructed principally using one of two methods. A first method uses a band/ring construction wherein the airfoils are first welded between inner and outer bands extending about 180°. Those arcuate bands with welded airfoils are then assembled, i.e., welded between the inner and outer rings of the stator of the turbine. The second method often consists of airfoils welded directly to inner and outer rings using a fillet weld at the interface. The latter method is typically used for larger airfoils where access for creating the weld is available.

There are inherent limitations using the band/ring method of assembly. A principle limitation in the band/ring assembly method is the inherent weld distortion of the flowpath, i.e., between adjacent blades and the steam path sidewalls. The weld used for these assemblies is of considerable size and heat input. That is, the weld requires high heat input using a significant quantity of metal filler. Alternatively, the welds are very deep electron beam welds without filler metal. This material or heat input causes the flow path to distort e.g., material shrinkage causes the airfoils to bow out of their designed shaped in the flow path. In many cases, the airfoils require adjustment after welding and stress relief. The result of this steam path distortion is reduced stator efficiency. The surface profiles of the inner and outer bands can also change as a result of welding the nozzles into the stator assembly further causing an irregular flow path. The nozzles and bands thus generally bend and distort. This requires substantial finishing of the nozzle configuration to bring it into design criteria. In many cases, approximately 30% of the costs of the overall construction of the nozzle assembly is in the deformation of the nozzle assembly, after welding and stress relief, back to its design configuration.

Also, methods of assembly using single nozzle construction welded into rings do not have determined weld depth, lack assembly alignment features on both the inner and outer ring and also lack retainment features in the event of a weld failure. Further, current nozzle assemblies and designs do not have common features between nozzle sizes that enable repeatable fixturing processes. That is, the nozzle assemblies do not have a feature common to all nozzle sizes for reference by machine control tools and without that feature each nozzle assembly size requires specific setup, preprocessing, and specific tooling with consequent increase costs. Accordingly, there has been demonstrated a need for an improved steam flowpath for a stator nozzle which includes low input heat welds to minimize or eliminate steam path distortion resultant from welding processes as well as to improve production and cycle costs by adding features that assist in assembly procedures, machining fixturing, facilitate alignment of the nozzle assembly in the stator and create a mechanical lock to prevent downstream movement of the nozzle assembly in the event of a weld failure.

BRIEF SUMMARY OF THE INVENTION

In a preferred embodiment, there is provided a nozzle assembly for a turbine comprising at least one nozzle blade having inner and outer sidewalls and, in part, defining a flowpath upon assembly into the turbine; an outer ring and an inner ring; the outer ring having one of a (i) male projection straddled by a pair of radially outwardly extending female recesses or (ii) a female recess straddled by a pair of radially inwardly extending male projections; the outer sidewall having another of a (i) female recess straddled by a pair of radially outwardly extending male projections or (ii) a male projection straddled by a pair of radially inwardly extending female recesses enabling interlocking engagement between the outer ring and the outer sidewall and against relative axial displacement; the outer ring and the outer sidewall being welded to one another and the inner ring and the inner sidewall being welded to one another.

In another preferred embodiment, there is provided a nozzle assembly for a turbine, comprising at least one nozzle blade having inner and outer sidewalls and, in part, defining a flow path upon assembly into the turbine; an outer ring and an inner ring; the inner ring having one of a (i) male projection straddled by a pair of radially inwardly extending female recesses or (ii) a female recess straddled by a pair of radially outwardly extending male projections; the inner sidewall having another of a (i) female recess straddled by a pair of radially inwardly extending male projections or (ii) a male projection straddled by a pair of radially outwardly extending female recesses enabling interlocking engagement between the inner ring and the inner sidewall and against relative axial displacement; the outer ring and the outer sidewall being welded to one another and the inner ring and the inner sidewall being welded to one another.

DETAILED DESCRIPTION OF THE INVENTION

Figure 1:
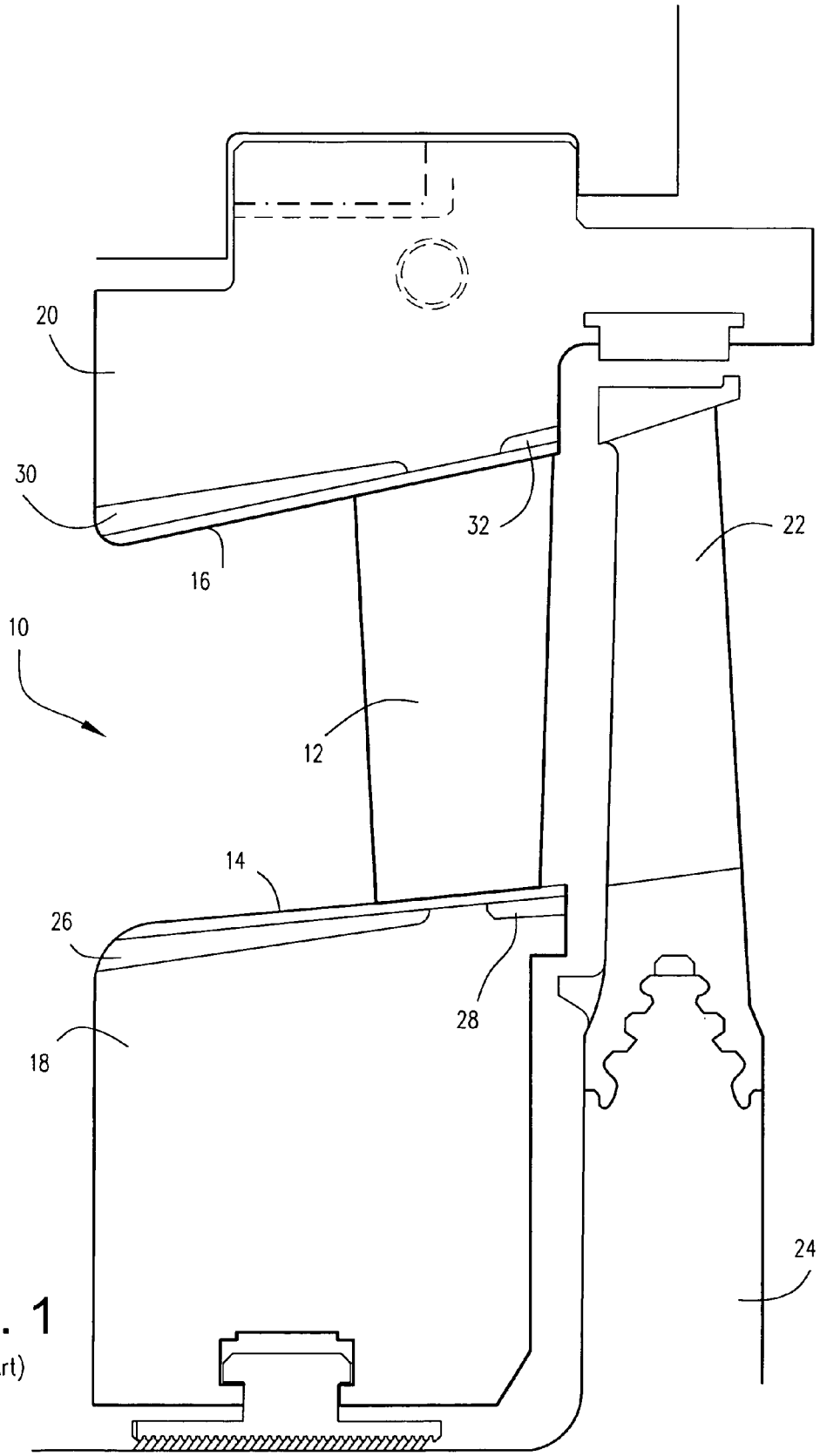
Fig. 1 (Prior Art)
FIG. 1 is a schematic line drawing illustrating a cross-section through a diaphragm stage of the steam turbine nozzle according to the prior art.

Referring to FIG. 1, there is illustrated a prior art nozzle assembly generally designated 10. Assembly 10 includes a plurality of circumferentially spaced airfoils or blades 12 welded at opposite ends between inner and outer bands 14 and 16, respectively. The inner and outer bands are welded between inner and outer rings 18 and 20, respectively. Also illustrated is a plurality of buckets 22 mounted on a rotor 24. It will be appreciated that nozzle assembly 10 in conjunction with the buckets 22 form a stage of a steam turbine.

Still referring to FIG. 1, the airfoils 12 are individually welded in generally correspondingly shaped holes, not shown, in the inner and outer bands 14 and 16 respectively.

The inner and outer bands 14 and 16 typically extend in two segments each of about 180 degrees. After the airfoils are welded between the inner and outer bands, this subassembly is then welded between the inner and outer rings 18 and 20 using very high heat input and deep welds. For example, the inner band 14 is welded to the inner ring 18 by a weld 26 which uses a significant quantity of metal filler or requires a very deep electron beam weld. Additionally, the backside, i.e., downstream side, of the weld between the inner band and inner ring requires a further weld 28 of high heat input. Similarly, high heat input welds 30, 32 including substantial quantities of metal filler or very deep electron beam welds are required to weld the outer band 16 to the outer ring 20 at opposite axial locations as illustrated. Thus, when the airfoils 12 are initially welded to the inner and outer bands 14, 16 and subsequently welded to the inner and outer rings 18 and 20, those large welds cause substantial distortion of the flowpath as a result of the high heat input and shrinking of the metal material and which causes the airfoils to deform from their design configuration. Also, the inner and outer bands 14, 16 may become irregular in shape from their designed shape, thus, further distorting the flowpath. As a result, the nozzle assemblies, after welding and stress relief, must be reformed back to their design configuration which, as noted previously, can result in 25-30% of the cost of the overall construction of the nozzle assembly. Lastly, if an EBW is used it may be used entirely from one direction going all the way to the opposing side (up to 4 inches thick).

There are also current singlet type nozzle assemblies which do not have a determinant weld depth and thus employ varying weld depths to weld the singlets into the nozzle assembly between the inner and outer rings. That is, weld depths can vary because the gap between the sidewalls of the nozzle singlet and rings is not consistent. As the gap becomes larger, due to machining tolerances, the weld depths and properties of the weld change. A tight weld gap may produce a shorter than desired weld. A larger weld gap may drive the weld or beam deeper and may cause voids in the weld that are undesirable. Current singlet nozzle designs also use weld prep at the interface and this requires an undesirable higher heat input filler weld technique to be used.

Figure 2:
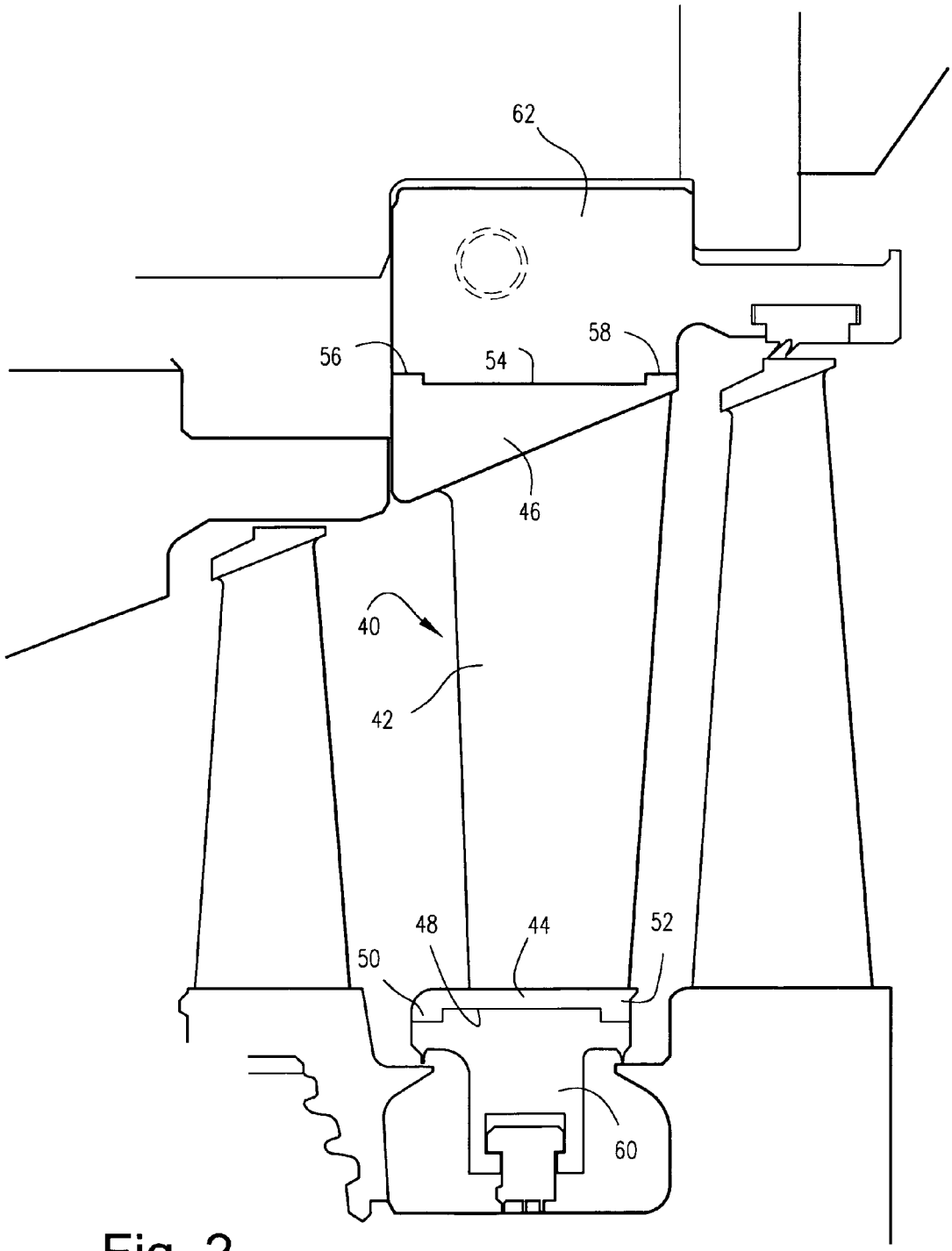
FIG. 2 is a line drawing of a steam turbine stage incorporating a nozzle assembly and weld features in accordance with a preferred embodiment of the present invention.
Figure 3:
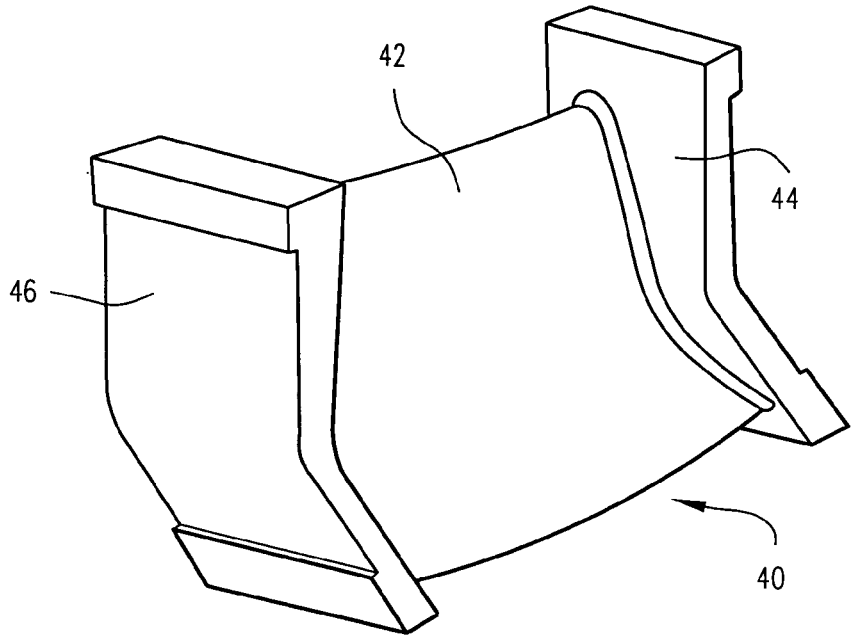
FIG. 3 is a perspective view of a singlet nozzle assembly.

Referring now to FIGS. 2 and 3, there is illustrated a preferred embodiment of a nozzle assembly according to the present invention which utilizes a singlet i.e., a single airfoil with sidewalls welded to inner and outer rings directly with a low heat input weld, which has mechanical features providing improved reliability and risk abatement due to a mechanical lock at the interface between the nozzle assembly and inner and outer rings as well as alignment features. Particularly, the nozzle assembly in a preferred embodiment hereof, includes integrally formed singlet subassemblies generally designated 40. Each subassembly 40 includes a single airfoil or blade 42 between inner and outer sidewalls 44 and 46, respectively, the blade and sidewalls being machined from a near net forging or a block of material. As illustrated, the inner sidewall 44 includes a female recess 48 flanked or straddled by radially inwardly projecting male steps or flanges 50 and 52 along leading and trailing edges of the inner sidewall 44. Alternatively, the inner sidewall 44 may be constructed to provide a central male projection flanked or straddled by a pair of radially outwardly extending male steps or flanges 56, 58 adjacent the leading and trailing edges of the outer sidewall 46. Alternatively, the outer sidewall 46 may have a central male projection flanked by radially inwardly extending female recesses along leading and trailing edges of the outer sidewall.

The nozzle singlets 40 are then assembled between the inner and outer rings 60 and 62, respectively, using a low heat input type weld. For example, the low heat input type weld uses a butt weld interface and preferably employs a shallow electron beam weld or shallow laser weld or a shallow flux-TIG or A-TIG weld process. By using these weld processes and types of welds, the weld is limited to the area between the sidewalls and rings adjacent the steps of the sidewalls or in the region of the steps of the inner and outer rings if the configuration is reversed at the interface than shown in FIG. 2. Thus, the welding occurs for only a short axial distance, preferably not exceeding the axial extent of the steps along opposite axial ends of the sidewalls, and without the use of filler weld material. Particularly, less than ½ of the axial distance spanning the inner and outer sidewalls is used to weld the singlet nozzle between the inner and outer rings. For example, by using electron beam welding in an axial direction from both the leading and trailing sides of the interface between the sidewalls and the rings, the axial extent of the welds where the materials of the sidewalls and rings coalesce is less than ½ of the extent of the axial interface. As noted previously, if an EBW weld is used, the weld may extend throughout the full axial extent of the registration of the sidewalls and the rings.

Figure 4:
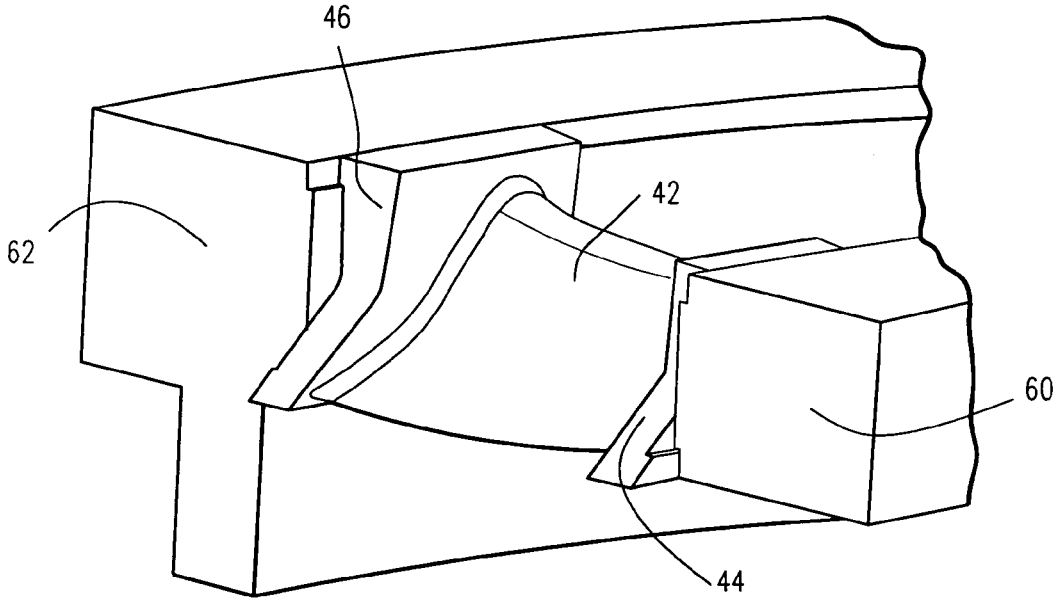
FIG. 4 is a schematic illustration of an assembly of the singlet nozzle of FIG. 3 between the inner and outer rings of the stator.

A method of assembly is best illustrated in FIG. 4 where the assembly process illustrated includes disposing a singlet 40 between the inner and outer rings 60, 62 when the rings and singlets are in a horizontal orientation. Thus, by rotating this assembly circumferentially relative to a fixed e-beam welder or vice versa, and then inverting the assembly and completing the weld from the opposite axial direction, the nozzle assemblies are welded to the inner and outer rings in a circumferential array thereof without high heat input or the use of filler material.

As clearly illustrated in FIG. 2, there is also a mechanical interface between the singlets 40, 50, 52, 56, 58 and the rings 60, 62. This interface includes the steps or flanges which engage in the recesses of the complementary part. This step and recess configuration is used to control the weld depth and render it determinant and consistent between nozzle singlets during production. This interlock is also used to axially align the nozzle singlets between the inner and outer rings. The interlock holds the nozzles in position during the assembly of the nozzle singlets between the inner and outer rings and the welding. That is, the nozzle singlets can be packed tightly adjacent one another and between the inner and outer rings while remaining constrained by the rings. Further, the mechanical interlock retains the singlets in axial position during steam turbine operation in the event of a weld failure, i.e., prevents the singlet from moving downstream into contact with the rotor.

Figure 5:
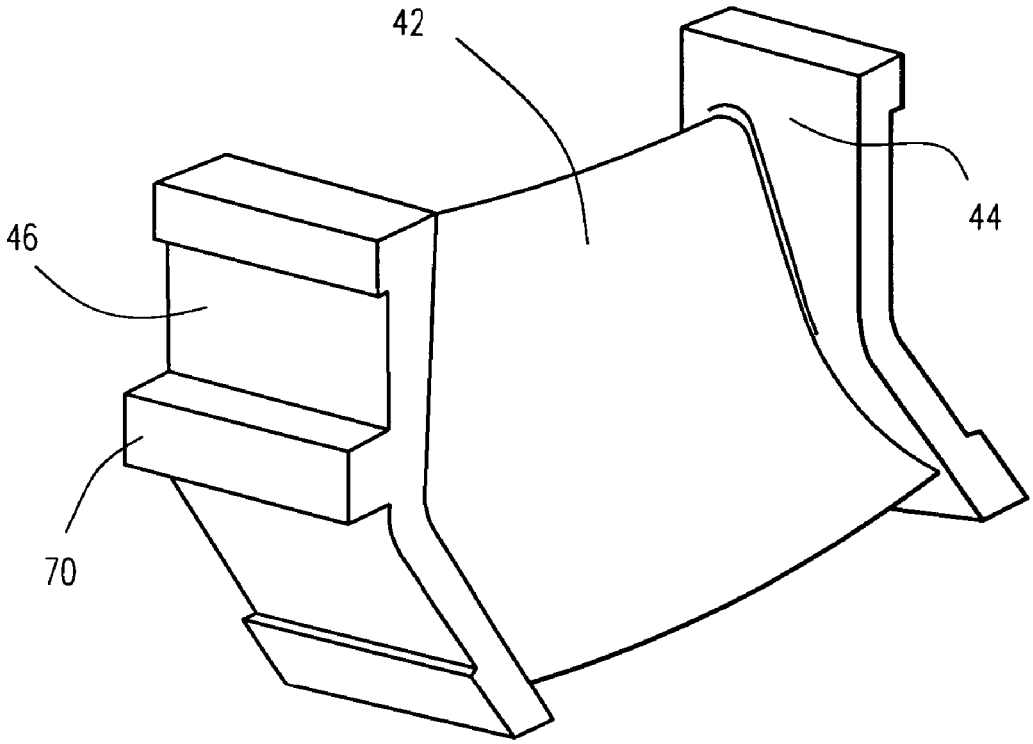
FIGS. 5 and 6 are enlarged perspective views of singlet nozzles incorporating alignment and reference features.
Figure 6:
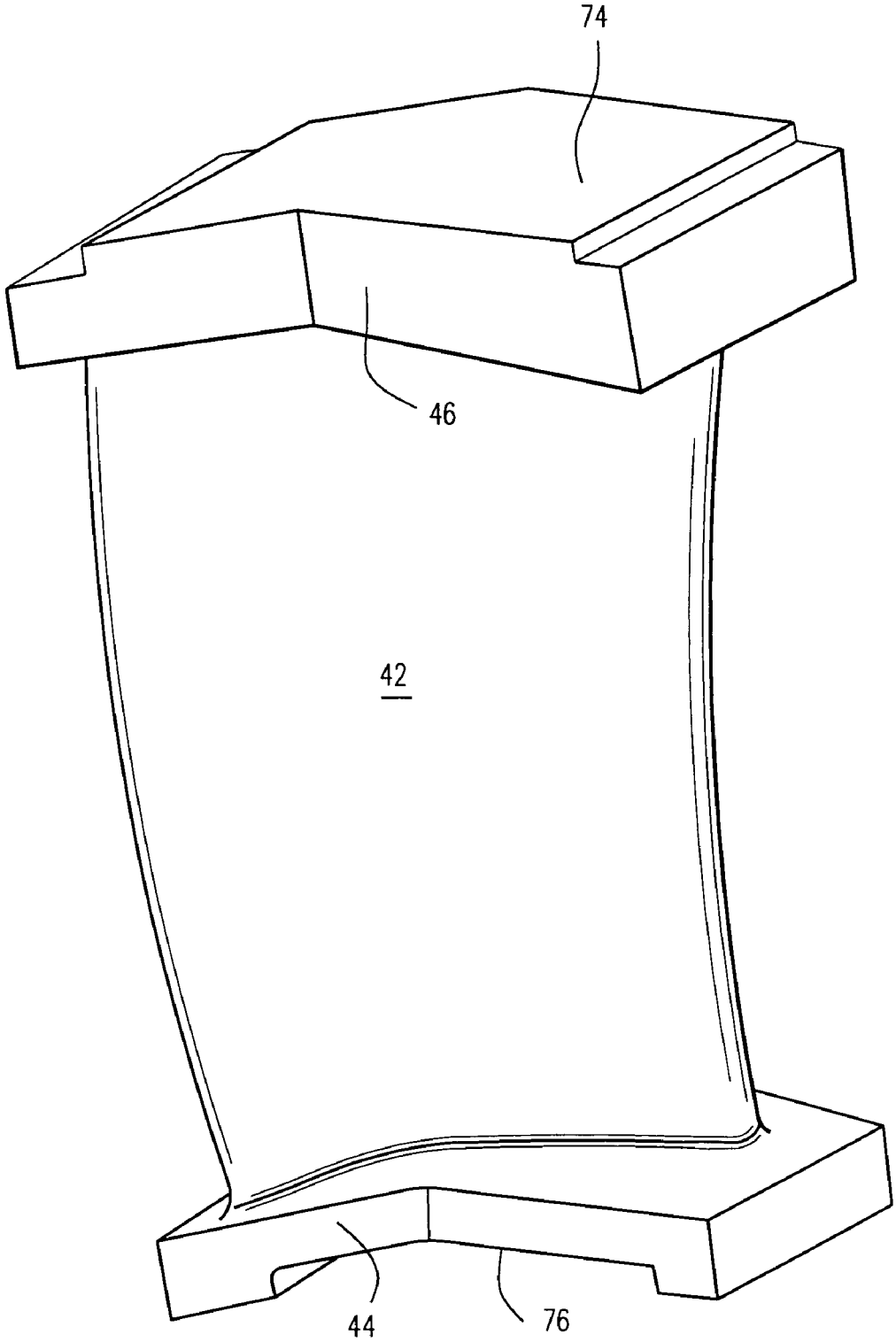
Figure 7:
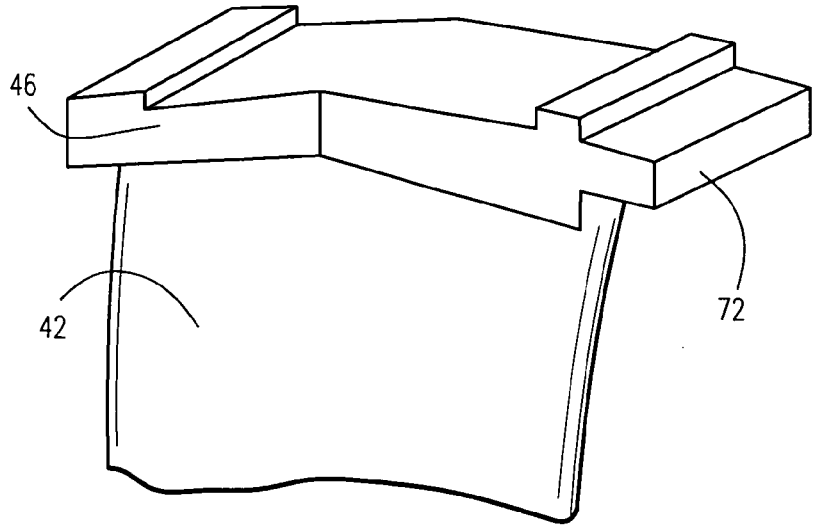
FIGS. 7 and 8 show partial perspective views of a nozzle assembly illustrating further embodiments of the alignment and reference features hereof.

Referring particularly to FIGS. 5, 6 and 7 there are further illustrated features added to the singlet design that assists with fixturing the nozzle singlet while it undergoes milling machine processes. These features are added to the nozzle singlet design to give a consistent interface to the machining singlet supplier. For example, in FIG. 5, one of those features includes a rib or a rail 70 on the top or bottom sidewall. Another fixturing feature is illustrated in FIG. 7 including a forwardly extending rib 72 along the outer sidewall 46. It will be appreciated that the rib 72 can be provided along the inner sidewall 44 and in both cases may be provided adjacent the trailing surfaces of those sidewalls. In FIG. 6, flats 74 may be provided on the outer surface of the outer sidewalls as well as flats 76 on the outer surface of the inner sidewall. Those flats 74 and 76 serve as machining datum to facilitate fixturing during machining processes. Current designs have a radial surface which is more complex and costly to machine as well as difficult to fixture for component machining.

Figure 8:
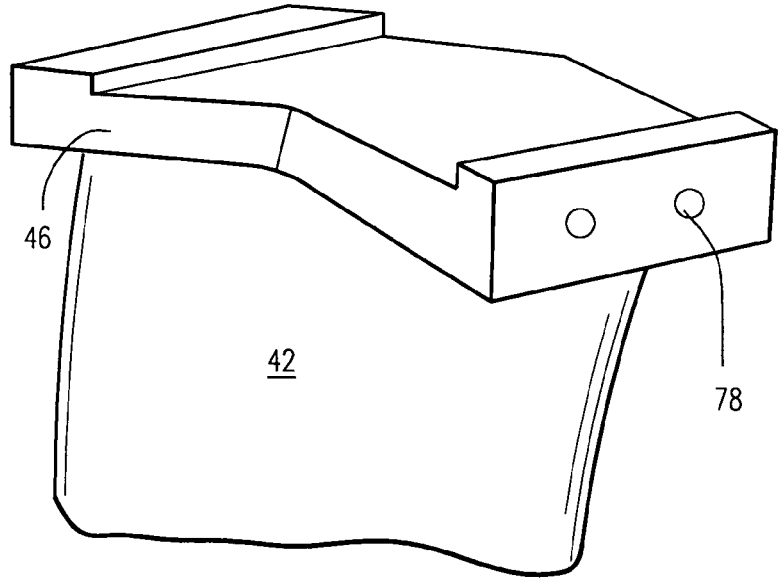

In FIG. 8, a pair of holes may be provided on the forward or aft outer sidewalls or on the forward or aft inner sidewalls. Those holes can be picked up consistently by the machining center between several nozzle designs and sizes to facilitate fixturing for machining purposes. Thus, by adding these features, a consistent interface to the machine supplier is provided which serves to reduce tooling, preprocessing, and machining cycle for the machining of the singlet. These fixturing features meet the need to provide a reference point so that the numerically controlled machining tool can identify the location of a feature common to all nozzles. For example, the two holes 78 illustrated in FIG. 8, provides two points on a fixture and establishes two planes which controls the entire attitude of the nozzle during machining enabling the machine to form any size of integral nozzle singlet.

It will be appreciated that the fixtures on each nozzle singlet can remain on the singlet or be removed from the singlet. For example, the rib 70 of the nozzle singlet illustrated in FIG. 5 can be received in a complementary groove formed in the associated inner or outer ring. In FIG. 7, it is preferable to cut off the assembly feature 72 after formation of the singlet. Also it will be appreciated that in FIG. 6 the flats need not register exactly with the arcuate surfaces along the inner and outer rings during assembly. The welding is performed preferably only along the leading and trailing margins of the singlets, i.e., along the steps or flanges 50, 52 56 and 58 and the inner and outer rings. Consequently the axial space between the steps or flanges and its radial registration with the interior surfaces of the rings can be void of weld or filler material and those surfaces may or may not contact one another.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle assembly for a turbine comprising:

at least one nozzle blade having inner and outer sidewalls and, in part, defining a flowpath upon assembly into the turbine;

an outer ring and an inner ring;

said outer ring having one of a (i) male projection straddled by a pair of radially outwardly extending female recesses or (ii) a female recess straddled by a pair of radially inwardly extending male projections;

said outer sidewall having another of a (i) female recess straddled by a pair of radially outwardly extending male projections or (ii) a male projection straddled by a pair of radially inwardly extending female recesses enabling interlocking engagement between said outer ring and said outer sidewall and against relative axial displacement;

said outer ring and said outer sidewall being welded to one another and said inner ring and said inner sidewall being welded to one another, wherein the axial extent of said weld between said outer ring and said outer sidewall is less than ½ of the axial extent of the registration between the outer ring and the outer sidewall.

2. A nozzle assembly according to claim 1 wherein one of said pair of male projections and one of said pair of female recesses interlocking with one another lies along an upstream portion of the outer ring and the outer sidewall and are welded to one another without the addition of weld filler material.

3. A nozzle assembly according to claim 2 wherein the weld between said one male projection and said one female recess is limited axially to about the axial extent of said one male projection and said one female recess.

4. A nozzle assembly according to claim 1 wherein one of said pair of male projections and one of said pair of female recesses interlocking with one another lies along a downstream portion of the outer ring and the outer sidewall and are welded to one another without the addition of filler material.

5. A nozzle assembly according to claim 4 wherein the axial extent of the weld between said one male projection and said one female recess is limited to about the axial extent of the engagement between said one male projection and said one female recess.

6. A nozzle assembly according to claim 1 wherein said pair of male projections lie on said outer sidewall adjacent respective upstream and downstream portions of the outer sidewall and project generally radially outwardly, said female recesses on said outer ring receiving the male projections of said outer sidewall, said weld being applied substantially solely locally between registering surfaces of the male projections of the outer sidewall and the recesses of the outer ring.

7. A nozzle assembly according to claim 1 wherein said inner ring has one of a (i) female recess straddled by a pair of radially outwardly extending male projections or (ii) a male projection straddled by a pair of radially inwardly extending female recesses, said inner sidewall having another of a pair of a (i) female recess straddled by a pair of radially inwardly extending male projections or (ii) a male projection straddled by a pair of radially outwardly extending female recesses, said inner ring and said inner sidewall being welded to one another.

8. A nozzle assembly according to claim 7 wherein one of said pair of male projections and one of said pair of female recesses interlocking with one another lies along an upstream portion of the inner ring and the inner sidewall and are welded to one another.

9. A nozzle assembly according to claim 7 wherein the axial extent of the weld between the inner sidewall and the inner ring is less than ⅓ of the axial extent of the registration between the inner sidewall and inner ring.

10. A nozzle assembly for a turbine, comprising:

at least one nozzle blade having inner and outer sidewalls and, in part, defining a flow path upon assembly into the turbine;

an outer ring and an inner ring;

said inner ring having one of a (i) male projection straddled by a pair of radially inwardly extending female recesses or (ii) a female recess straddled by a pair of radially outwardly extending male projections;

said inner sidewall having another of a (i) female recess straddled by a pair of radially inwardly extending male projections or (ii) a male projection straddled by a pair of radially outwardly extending female recesses enabling interlocking engagement between said inner ring and said inner sidewall and against relative axial displacement;

said outer ring and said outer sidewall being welded to one another and said inner ring and said inner sidewall being welded to one another, wherein the axial extent of said weld between said inner ring and said inner sidewall is less than ½ of the axial extent of the registration between the inner ring and the inner sidewall.

11. A nozzle assembly according to claim 10 wherein one of said pair of male projections and one of said pair of female recesses interlocking with one another lies along an upstream portion of the inner ring and the inner sidewall and are welded to one another without the addition of weld filler material.

12. A nozzle assembly according to claim 10 wherein one of said pair of male projections and one of said pair of female recesses interlocking with one another lies along a downstream portion of the inner ring and the inner sidewall and are welded to one another without the addition of filler material.

13. A nozzle assembly for a turbine, comprising:

at least one nozzle blade having inner and outer sidewalls and, in part, defining a flowpath upon assembly into the turbine;

said outer sidewall having one of a (i) female recess straddled by a pair of radially outwardly extending male projections or (ii) a male projection straddle by a pair of radially inwardly extending female recesses enabling interlocking engagement with an outer ring of the turbine;

said inner sidewall having one of a (i) female recess straddled by a pair of radially inwardly extending male projections and (ii) a male projection straddled by a pair of radially outwardly extending female recesses enabling interlocking engagement with an inner ring of the turbine;

said outer ring and said outer sidewall being welded to one another and said inner ring and said inner sidewall being welded to one another; and a fixturing element carried by one of said inner and outer sidewalls to facilitate fixturing the nozzle for machining processes, wherein said fixturing element comprises a rib or rail projecting from one of said inner and outer sidewalls.

* * * * *

UNITED STATES PATENT AND TRADEMARK OFFICE

CERTIFICATE OF CORRECTION

PATENT NO. : 7,427,187 B2
APPLICATION NO. : 11/331024
DATED : September 23, 2008
INVENTOR(S) : Steven Burdgick et al.

It is certified that error appears in the above-identified patent and that said Letters Patent is hereby corrected as shown below:

At column 3, line 61 after the word "flanked" insert the phrase --by radially outward extending female recesses adjacent the leading and trailing edges of the inner sidewall. Similarly, the outer sidewall 46, as illustrated, includes a female recess 54 flanked--

Signed and Sealed this

Seventeenth Day of February, 2009

John Doll

JOHN DOLL
*Acting Director of the United States Patent and Trademark Office*